US011072954B2

(12) United States Patent
Hasler

(10) Patent No.: US 11,072,954 B2
(45) Date of Patent: Jul. 27, 2021

(54) THREE-PART DOOR HINGE ADJUSTABLE IN THREE DIMENSIONS (3D)

(71) Applicant: Thomas Hasler, Hinterforst (CH)

(72) Inventor: Thomas Hasler, Hinterforst (CH)

( * ) Notice: Subject to any disclaimer, the term of this patent is extended or adjusted under 35 U.S.C. 154(b) by 64 days.

(21) Appl. No.: 15/916,835

(22) Filed: Mar. 9, 2018

(65) Prior Publication Data

US 2018/0258674 A1 Sep. 13, 2018

(30) Foreign Application Priority Data

Mar. 10, 2017 (EP) ..... 17160256

(51) Int. Cl.
*E05D 7/00* (2006.01)
*E05D 3/02* (2006.01)

(52) U.S. Cl.
CPC ..... *E05D 7/0054* (2013.01); *E05D 7/0027* (2013.01); *E05D 2003/025* (2013.01); *E05D 2007/0063* (2013.01); *E05Y 2900/132* (2013.01)

(58) Field of Classification Search
CPC ..... E05D 7/04; E05D 7/0054; E05D 7/0027; E05D 2003/025; E05D 2007/0063; E05Y 2900/132
See application file for complete search history.

(56) References Cited

U.S. PATENT DOCUMENTS 1,484,536 A * 2/1924 Way ..... E05D 7/0054 16/242
1,540,581 A * 6/1925 Way ..... E05D 7/0054 16/242
1,900,081 A * 3/1933 Swerer ..... E05D 7/0054 16/242
2,533,502 A * 12/1950 Philips ..... E05D 7/0054 16/242
2,724,144 A * 11/1955 Lohrman ..... E05D 7/0054 16/242

(Continued)

FOREIGN PATENT DOCUMENTS

DE 9215565 U1 3/1994
EP 0962616 A1 * 12/1999 ..... E05D 7/0054

(Continued)

OTHER PUBLICATIONS

EP 17 16 0256 European Search Report, Sep. 11, 2017, pp. 1-7.

*Primary Examiner* — Emily M Morgan
(74) *Attorney, Agent, or Firm* — Muncy, Geissler, Olds & Lowe, P.C.

(57) ABSTRACT

A door hinge is disclosed having a frame hinge part and a leaf hinge part, which are pivotable in relation to one another about a pin on a pivot axis. The frame hinge part has an upper and lower housing, the leaf hinge part has a middle housing, insertable between the upper and the lower housing. The pin is insertable into the lower, the middle, and the upper housing, and rotatably mounted in the upper and lower housings. Two eccentricities are provided in the middle housing of the leaf hinge part. The middle housing can be clamped in a rotationally-fixed manner with the pin, so that the leaf hinge part is pivotable in relation to the frame hinge part about the pin. In the non-clamped state, the leaf hinge part is adjustable by means of the two eccentricities in two dimensions transverse to the pivot axis.

14 Claims, 8 Drawing Sheets

(56) References Cited

U.S. PATENT DOCUMENTS

| | | | | | |
|---|---|---|---|---|---|
| 5,689,855 | A * | 11/1997 | Tang | E05D 7/0054 | 16/235 |
| 6,484,363 | B1 * | 11/2002 | Chung | E05D 7/0054 | 16/235 |
| 7,162,774 | B1 * | 1/2007 | Von Resch | E05D 7/0054 | 16/236 |
| 2004/0107541 | A1 * | 6/2004 | Miller | E05D 5/10 | 16/386 |

FOREIGN PATENT DOCUMENTS

| | | | | |
|---|---|---|---|---|
| EP | 1672155 | A1 * | 6/2006 | E05D 5/023 |
| EP | 2586944 | A1 | 10/2011 | |
| GB | 624 111 | A | 5/1949 | |
| GB | 2 276 204 | A | 9/1994 | |

* cited by examiner

Fig. 3h
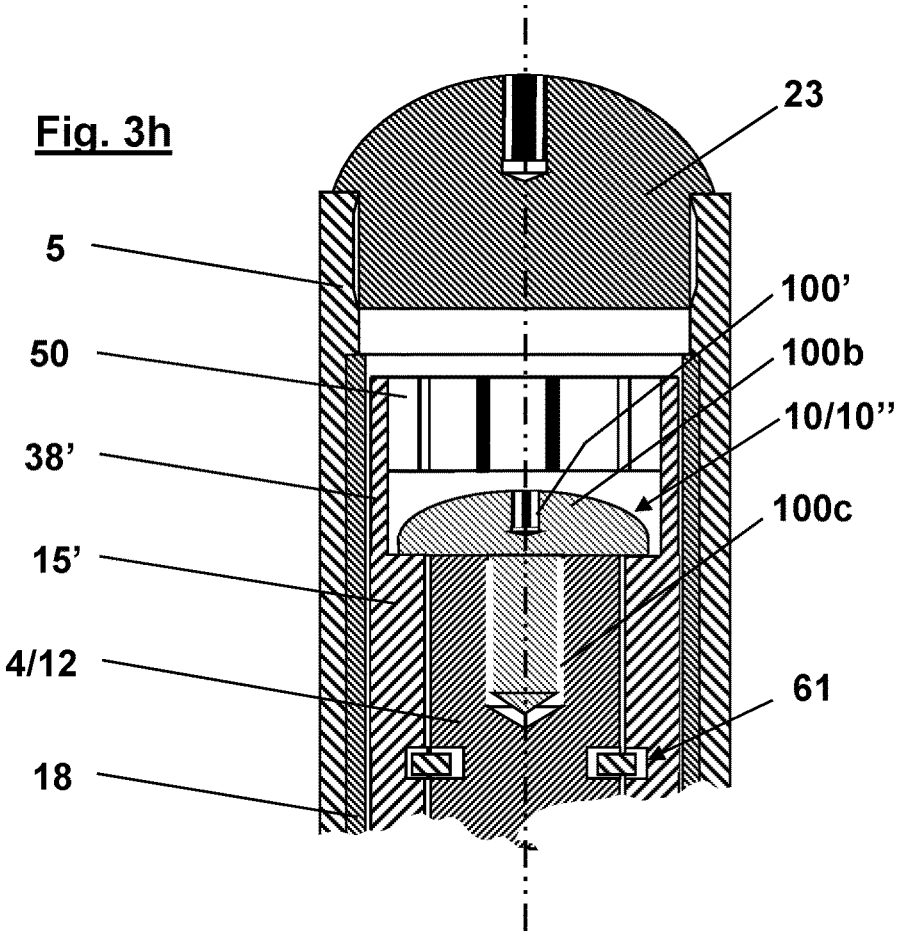
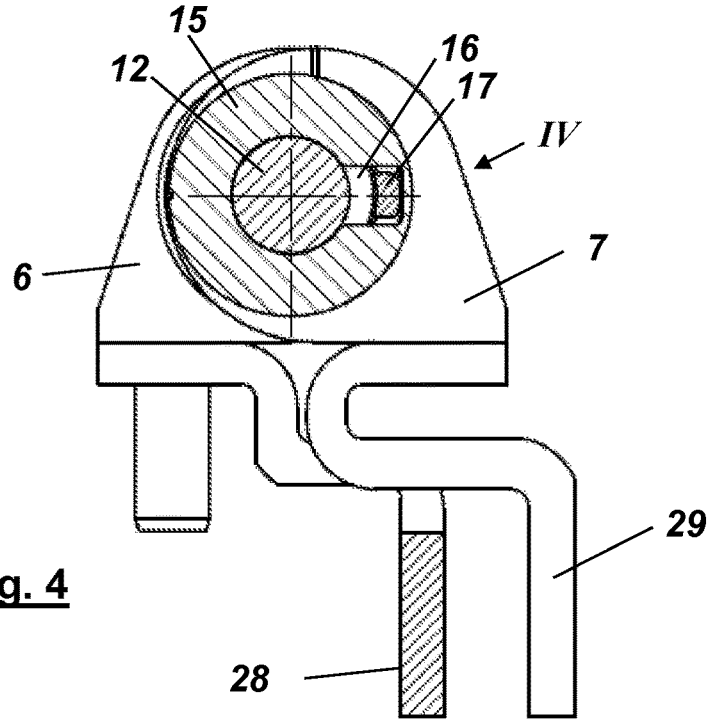
Fig. 4

THREE-PART DOOR HINGE ADJUSTABLE IN THREE DIMENSIONS (3D)

CROSS REFERENCE TO RELATED APPLICATIONS

This application claims priority to European Patent Application No. 17160256.8, which was filed in the European Patent Office on Mar. 10, 2017, and which is herein incorporated by reference in its entirety.

BACKGROUND OF THE INVENTION

The present invention relates to a three-part door hinge, also called a bolt hinge or hinge in short, as is known for producing a pivoting capability of doors, windows, or the like in relation to a frame.

Three-part door hinges are used more for heavy doors and the like because of the force absorption and distribution, in contrast to two-part door hinges, also called pin hinges, which are used more for lighter elements.

Since most three-part door hinges are installed vertically, the terms "upper", "lower", etc. are used hereafter to be able to refer to components so they are unambiguously identifiable. However, it is apparent that such door hinges can also be installed horizontally or diagonally in space.

A three-part door hinge comprises a leaf hinge part for fastening on the door leaf or window sash, respectively (referred to hereafter as the leaf element) and a frame hinge part for fastening on the respective frame. The leaf hinge part has a hollow-cylindrical receptacle housing (referred to as the middle housing hereafter) and a fastening flange for fastening on the leaf element (for example, door leaf, window sash, etc.). The frame hinge part is provided with a first hollow-cylindrical housing (referred to as the upper housing hereafter) and a second hollow-cylindrical housing (referred to as the lower housing hereafter), and also with a fastening web, which protrudes more or less radially or tangentially from the upper and the lower housings and connects the housings to one another—axially spaced apart from one another. In this case, the distance between the housings is dimensioned so that the middle housing of the leaf sash part fits axially between the upper and the lower housings of the frame hinge part. During the installation, a pin is pushed from one side through the housing of the three-part hinge and axially fixed therein such that in the installed state, it holds together all housings in an aligned manner and a door leaf or window sash is pivotable in relation to the frame about a pivot axis of the door hinge extending through the housings and the pin.

Three-part door hinges, like the one described above, are known from the prior art. Such door hinges which have an adjustment mechanism for adjusting the leaf element in at least one axial dimension are also known. In this case, different mechanisms are implemented for the adjustability. However, the following disadvantages frequently result in the adjustable three-part door hinges known from the prior art:

- restricted accessibility of one or more of the adjustment mechanisms (for example, adjusting screws) required for the adjustability, which then makes it necessary, for example, to open the leaf element or even take it off the hinge;
- large number of components, which additionally sometimes have a complex shape, which increases the production costs and the installation effort;

- complex construction, from which, in addition to a high production expenditure, a difficult installation also results.

BRIEF SUMMARY OF THE INVENTION

The object of the invention is to provide an improved door hinge, which remedies these disadvantages.

This object is achieved by the implementation of the features of the independent claims. Features which refine the invention in an advantageous manner can be inferred from the dependent patent claims.

The invention relates to a three-part door hinge according to claim 1 and a method for adjusting this door hinge according to the independent method claim.

The subject matter of the invention is a three-dimensionally adjustable door hinge, in which the adjustability of a leaf hinge part of the door hinge in two dimensions is provided on the basis of two serial eccentricities. An adjustability in a third dimension is provided by at least one adjusting screw, which axially displaces a pin of the door hinge.

The three-part door hinge is provided with a pin, with a frame hinge part for fixing on a frame, and with a leaf hinge part for fastening on a leaf element. The door hinge is used for pivoting the leaf element in relation to the frame about a pivot axis of the door hinge. The frame hinge part has an upper housing and a lower housing, wherein the housings are fixed at a defined distance and concentrically in relation to one another by means of a fastening web. In the assembled state, a middle housing of the leaf hinge part is arranged between the upper and the lower housings of the frame hinge part and the pin extends through all housings of the frame hinge part and the leaf hinge part. The pin is mounted so it is adjustable in relation to the frame hinge part in its axial position by means of an adjusting screw located in the lower housing, which results in an adjustability of the door hinge (1) in a first dimension. In the region of the middle housing of the leaf hinge part, two eccentricities are provided, which interact such that a middle longitudinal axis of the middle housing is adjustable parallel to the pivot axis to any arbitrary point within a virtual circular plane, which is defined by the two eccentricities and is aligned orthogonally to the pivot axis, so that an adjustability results in two further dimensions orthogonal to the pivot axis (S). The three-part door hinge presented here is therefore three-dimensionally adjustable.

Adjustments in the two dimensions perpendicular to the pivot axis, i.e., along a plane parallel to the leaf element and orthogonal to this plane, are achieved in principle similarly as with an articulated arm. Two serial, i.e., more or less "superimposed" eccentricities each cause a circular adjustability of the door suspension taken per se. If these two additive eccentric adjustments are adapted to one another, lateral adjustments are achieved in two dimensions perpendicular to the pivot axis. The two eccentric adjustments are achieved, on the one hand, by the pin of the door hinge, which is formed eccentrically in its middle section, and, on the other hand, by an eccentric bushing, which encloses the eccentric section of the pin.

The pin has a lower pin section, a middle pin section, and an upper pin section, wherein the middle pin section is formed eccentrically with respect to the upper and the lower pin sections, and the pin sections are separated from one another by shoulders. The middle pin section therefore forms one of the above-described eccentricities. An eccentric bushing, which is provided in the middle housing of the leaf hinge part in the assembled state and is enclosed thereby, forms the second of the above-described eccentricities. The middle pin section is enclosed by the eccentric bushing in the assembled state. The middle pin section, the eccentric bushing, and the middle housing of the leaf hinge part are connectable to one another in a rotationally-fixed manner, while the pin is mounted with its upper pin section in the upper housing and with its lower pin section in the lower housing so it is rotatable about the pivot axis.

Bearing bushings are preferably pressed in a rotationally-fixed manner into the upper and the lower housings, so that the pin slides off at the bearing bushings during its rotation in these housings. This reduces the wear, in particular if the bearing bushings are manufactured from a self-lubricating bearing alloy, for example, a self-lubricating bronze.

The rotationally-fixed connection between middle pin section, the eccentric bushing, and the middle housing of the leaf hinge part is achievable in various ways: for example, it is possible to provide radially extending threaded holes in the middle housing for accommodating grub screws and to provide the eccentric bushing with corresponding oblong holes extending in the circumferential direction, which are also provided to engage with the grub screws at the boundaries thereof extending in the circumferential direction. By means of the associated grub screws, which are screwed into the radial threaded holes and which engage through the oblong holes to the eccentric middle pin section, clamping of the middle housing with the middle pin section and the eccentric bushing is then possible. The oblong holes enable in this case an adjustment of the eccentric bushing by pivoting thereof, before it is clamped with the other elements by means of the grub screws. Another conceivable option would be to design the eccentric bushing such that it protrudes beyond the middle housing at least on one side. By means of clamps which can be plugged on externally, and which grip, on the one hand, the middle housing, and, on the other hand, the section of the eccentric bushing protruding out of the housing and a section of the pin accessible between the housings of the frame hinge part and the middle housing and clamps them with one another. A particularly preferred manner of connecting the middle pin section, the eccentric bushing, and the middle housing to one another in a rotationally-fixed manner is described on the basis of the figures and claimed in the dependent claims. The first two described options result in a somewhat less elegant door hinge than the last-mentioned option for clamping described in greater detail on the basis of the figures, because in the last-mentioned option, the clamping takes place more or less "invisibly" inside the door hinge.

The door hinge and/or its individual components are preferably designed such that in the assembled state, the eccentric bushing rests with its lower end face on the lower shoulder of the pin and the middle housing has a collar in the region of its upper end, which rests at least partially on the upper end face of the eccentric bushing. This design results in a favorable force introduction from the leaf element via the leaf hinge part to the pin and the frame hinge part.

In one preferred embodiment, the upper pin section is enclosed in the assembled state in the upper housing by a driver bushing, wherein the driver bushing and the eccentric bushing are connected to one another by means of a tongue-and-groove connection such that a rotational adjustment of one bushing is transferred to the other bushing. For this purpose, eccentric bushing and driver bushing have at least one groove or indentation—on the end faces thereof facing toward one another in the assembled state—and at least one driver in the form of a driver lug or a driver cam or driver pin, which are adapted to one another in the geometrical design thereof so that during a pivot of one bushing, the other bushing is also moved by means of this at least one tongue-and-groove connection and is pivoted by the same amount and in the same direction.

It is particularly advantageous if the pin has a thread on its upper end to accommodate a lock element, wherein the thread is preferably an external thread and the lock element is preferably a lock nut. However, it is also possible to design the lock element as a lock screw and to provide an internal thread instead of the external thread. It is even better if the upper housing is designed so that the lock element is arranged inside the upper housing and can be screwed onto the upper end of the pin, because in this way a particularly visually appealing shape of the three-part door hinge results.

In a loosened state, the lock element provides an adjustability of the eccentric middle pin section and the eccentric bushing, while in a tightened state, it provides a fixation of an adjustment of the eccentric middle pin section and the eccentric bushing.

In particular, this functionality is implemented in that in the assembled state, the pin can be fixedly clamped in a rotationally-fixed manner by means of the lock element screwed onto its upper end with the driver bushing, the middle housing, and with the eccentric bushing, wherein the lock element presses against an offset of the driver bushing upon tightening.

If the pin tapers from bottom to top in steps at the lower shoulder from the lower pin section toward the middle pin section and at the upper shoulder from the middle pin section toward the upper pin section, it is possible to keep the housing slender in its external diameter and also to form the housings having approximately equal internal diameters, in spite of the fact that different numbers of bushings have to be accommodated in the housings. This simplifies the production and reduces the production costs.

It is particularly advantageous, because it is particularly elegant in appearance and comfortable to handle, if the pin has, on its lower end face, a drive profile, in particular a hex socket, for the rotational adjustment of the eccentrically formed middle pin section and the adjusting screw for axially adjusting the pin is formed as a hollow screw having a drive profile. The drive profile is formed in this case as a through-hole opening and is at least sufficiently larger than the drive profile of the pin that a wrench matching with the drive profile of the pin is insertable through the drive profile of the adjusting screw and into the drive profile of the pin and the pin is pivotable with the aid of the wrench.

Thrust washers having through-hole openings and/or washers having through-hole openings are advantageously arranged between the pin and the adjusting screw to absorb the axial forces. The middle openings are dimensioned in this case such that the wrench matching with the drive profile of the pin is insertable through them and into the drive profile of the pin (4).

For secure fixing of the selected setting, the adjusting screw can optionally be able to be secured using a lock screw, which preferably can also be screwed into the internal thread of the lower housing of the frame hinge part. The lock screw is then also formed as a hollow screw having a drive profile, wherein the drive profile is again formed as a pervasive middle opening, which is at least sufficiently larger than the drive profile of the adjusting screw that a wrench matching with the drive profile of the adjusting screw is guidable through the drive profile (90) of the lock screw and insertable into the drive profile of the adjusting screw (8).

It is also very elegant in appearance and comfortable to handle if the driver bushing arranged in the upper housing of the frame hinge part protrudes with its upper end region beyond the upper end of the pin located therein, but the upper housing protrudes beyond the driver bushing. It is then advantageously provided in its upper end region with a drive profile—in particular a hex socket—which is used for the rotational adjustment of the driver bushing and, via the at least one tongue-and-groove connection, also for the rotational adjustment of the eccentric bushing. An internal diameter of the driver bushing in this upper end region is selected such that the lock element for the upper securing of the pin is insertable through the end region of the driver bushing and can be screwed together with the upper end of the pin.

If a leaf element is fastened on a frame by means of a door hinge which is designed according to the above statements, for the three-dimensional adjustment of the leaf element in relation to the frame, the leaf hinge part thus has to be adjusted in relation to the frame hinge part according to the following method: The leaf hinge part is adjusted in a first dimension in the direction of the pivot axis of the door hinge by pivoting the adjusting screw, which is screwed into the lower housing of the frame hinge part. The lock element possibly has to be loosened first for this purpose. If a lock element is provided, it thus is tightened again after the pivoting of the adjusting screw, to fix the selected setting in the axial direction. An adjustment of the leaf hinge part in relation to the frame hinge part in two further dimensions, namely orthogonally to the direction of the pivot axis, is achievable by pivoting two eccentricities arranged in the region of the leaf hinge part.

The latter is possible in particular by loosening a lock element, which provides the adjustability of an eccentric middle pin section arranged in the leaf hinge part and an eccentric bushing also located therein when it is loosened. By pivoting the driver bushing mounted in the upper housing, by means of the tongue-and-groove connection, the eccentric bushing mounted in the middle housing of the leaf hinge part is pivoted. Moreover, by pivoting the pin, the eccentric middle pin section can be pivoted in relation to the eccentric bushing. By tightening the lock element, an adjustment of the door hinge obtained by pivoting the eccentric middle pin section and the eccentric bushing is fixed.

In particular, by tightening the lock element, the pin is fixedly clamped in a rotationally fixed manner at least with the middle housing of the leaf hinge part and the eccentric bushing located therein.

This method is particularly advantageous and comfortable, since all adjustments and the subsequent fixing of these adjustments take place without removing a leaf element fixedly connected to the leaf hinge part from the hinge.

The method can also be carried out without the door hinge having to be completely or partially disassembled or removed for this purpose. To protect the door hinge from soiling and so that lubricants cannot escape, cover screws are optionally provided in the upper and lower housings of the frame hinge part. To carry out the method for adjusting the door hinge, only the cover screws have to be unscrewed. All other elements which have to be actuated for the adjustment are directly accessible using the matching wrenches after the unscrewing of the cover screws or if the cover screws are not present.

The door hinge according to the invention is designed in particular for heavy doors in vertical use, since lesser lever forces thus act. In particular in the case of such a use, the arrangement of thrust washers between the pin and the adjusting screw prevents the hinge from being damaged by the pivoting of a heavy door.

Since the weight is absorbed in the lower frame hinge part, various attachment types and therefore hinge types result for doors opening to the left or right, respectively.

The door hinge can be screwed on (leaf hinge part with the leaf element/frame hinge part with the frame) or, for example, also welded on. The individual components of the door hinge are preassembled for the installation such that on location, essentially only leaf hinge part, frame hinge part, pin, lower adjusting screw, possibly thrust washers and/or washers, and also lock elements and—if provided—two cover screws have to be installed. During the installation on location, the frame hinge part is fastened on the frame and the leaf hinge part is fastened on the leaf element. The leaf element with the leaf hinge part fastened thereon is then moved toward the frame such that the middle housing associated with the leaf hinge part is inserted between the upper housing and the lower housing of the frame hinge part. The pin is inserted through the lower housing, middle housing, and upper housing, so that they are aligned via the pin. The pin is secured in the housings by means of the upper lock element. The adjusting screw and if necessary previously also thrust washers and/or washers are introduced from below into the lower housing and secured if necessary by means of the lower lock element.

A circumferential groove can optionally be provided in the pin for a break-in safeguard, into which a snap ring is pressed before the pin is pressed into the housing. The circumferential groove is preferably located in the region of the upper or lower pin section. The circumferential groove is particularly advantageously arranged as a thread recess in the upper pin section, so that the snap ring can be inserted into the groove from above over the pin before the installation. A recess in the upper region of the pin and the driver bushing is also conceivable, which is also provided with a snap ring before installation for securing against break-in. In all of these variants, the snap ring prevents the pin from being able to be removed from the door hinge again after the installation and the door hinge from being able to come apart.

BRIEF DESCRIPTION OF THE DRAWINGS

The device according to the invention will be described in greater detail solely by way of example hereafter on the basis of specific exemplary embodiments schematically illustrated in the drawings, wherein further advantages of the invention will also be discussed. In the specific figures

FIG. 3*h* shows, in a sectional view similar to FIG. 3*a* and enlarged, a further embodiment of a lock element;

FIG. 4: shows the door hinge according to the invention from FIG. 3*a* in a sectional view along section line IV-IV in FIG. 3*a;*

DETAILED DESCRIPTION

Figure 1:
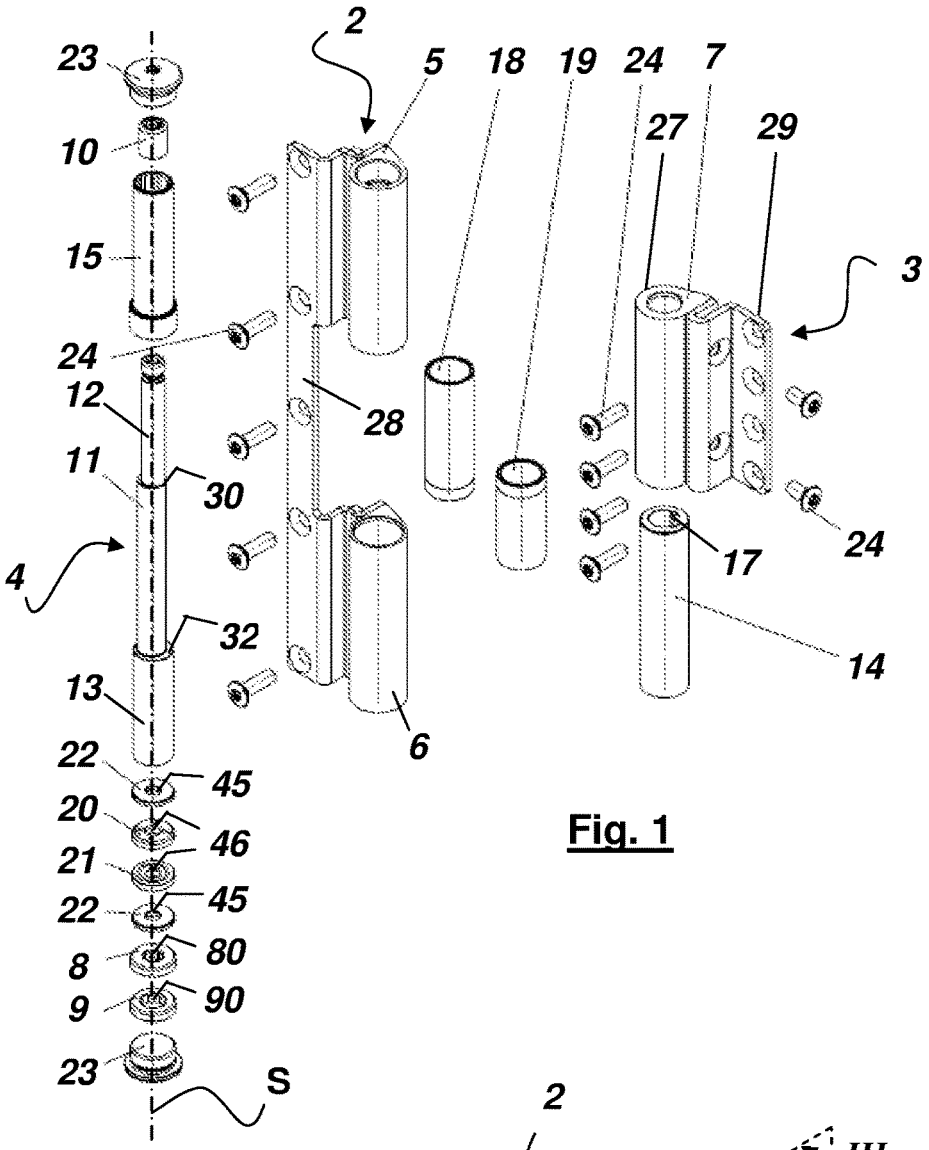
FIG. 1: shows an exploded drawing of an embodiment of the door hinge according to the invention.

The structure and the functionality of the door hinge 1 according to the invention will be explained hereafter on the basis of FIGS. 1 to 5. The door hinge 1 has a frame hinge part 2 and a sash hinge part 3, which are pivotable about a pin 4 in relation to one another about a pivot axis S.

The pin 4 has two shoulders 30, 32, which divide it into a lower pin section 13, a middle pin section 11, and an upper pin section 12. The pin 4 tapers at each of the shoulders 30, 32 in steps from the lower section 13 at the lower shoulder 32 toward the middle section 11 and from the middle section 11 at the upper shoulder 30 toward the upper section 12. In this case, the upper and the lower sections 12, 13 are concentric with respect to one another, but the middle section 11 is formed eccentrically with respect to the upper section 12 and with respect to the lower section 13.

The frame hinge part 2 has two housings 5, 6 formed as hollow cylinders, which are referred to hereafter as the upper housing 5 and the lower housing 6. The housings 5, 6 are fixedly connected to one another by means of a web 28, wherein the web 28 fixes the housings 5, 6 at a defined distance and concentrically in relation to one another. The web 28 is additionally used for fixing the frame hinge part 2 on a door or window frame. The housings 5, 6 are each openly accessible axially from both sides.

The two housings 5, 6 are optionally provided on the sides facing away from one another, in the respective end regions thereof, with internal threads, into which cover screws 23 can be screwed. The cover screws 23 close the upper and lower housings 5, 6 of the door hinge 1 and thus protect the assembled door hinge 1 from environmental influences, such as moisture, dust, and dirt, and prevent an escape of possible lubricant.

The housings 5, 6 of the frame hinge part 2 are used to accommodate bearing bushings 18, 19, which are pressed in a rotationally-fixed manner into the housings 5, 6 in preassembly. The bearing bushings 18, 19 are dimensioned in this case so that the internal threads in the housings 5, 6 remain freely accessible for the cover screws 23 and possible further screws (see below). In the installed state, a driver bushing 15 is moreover mounted in the first bearing bushing 18 of the upper housing 5, which has at least one indentation or driver groove 16, which extends along a small circumferential segment of the driver bushing 15, on its lower end face, which is oriented toward the lower housing 6 in the installed state.

The leaf hinge part 3 has a hollow-cylindrical housing 7, which is also accessible from both sides, and from which a flange 29 protrudes, which is used for fastening the leaf hinge part 3 on a door leaf or window sash, etc. The housing 7 is also referred to hereafter as the middle housing 7, because it is insertable between the upper housing 5 and the lower housing 6 of the frame hinge part 2 and therefore represents the middle housing 7 with respect to the entire door hinge 1 (see FIGS. 2 and 3*a*). The external diameter of all housings 5, 6, 7 is preferably equal, so that a pleasant aesthetic form of the door hinge results. Instead of a cylindrical outer form of the housings 5, 6, 7, it is also conceivable to select the external form as polygonal or in any arbitrary other way, for example, to also form each of the three housings in drop form or to design all three together such that the exterior thereof emulates a drop, etc., while the housings are still formed on the inside as hollow cylinders.

Figure 2:
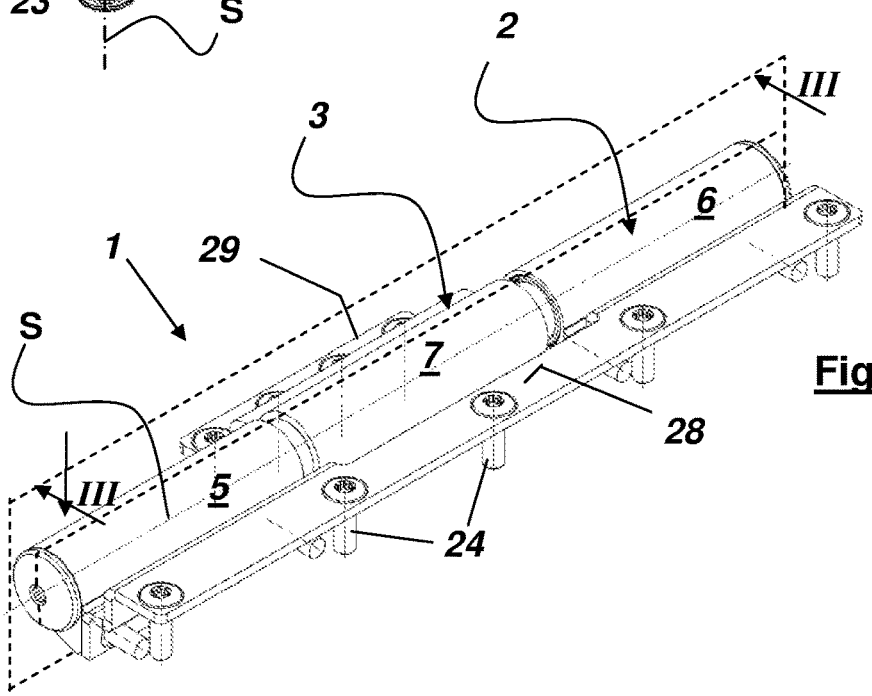
FIG. 2: shows the door hinge from FIG. 1 in the assembled state in perspective.

In FIGS. 1 and 2, the web 28 and the flange 29 are each shown having holes and associated screws 24. Frame hinge part 2 and leaf hinge part 3 can thus be screwed onto the corresponding frame or leaf elements in the illustrated form. However, it is conceivable—in particular in the case of safety doors—that the frame and/or the leaf element at least partially consist of a weldable material, the web 28 and the flange 29 are then also manufactured from a corresponding weldable material, so that the door hinge 1 and/or the frame hinge part 2 can be welded with its web 28 on the frame and the leaf hinge part 3 can be welded with its flange 29 on the corresponding leaf element.

The middle housing 7 is used to accommodate an eccentric bushing 14. It has a collar 27, which is used as the stop for the eccentric bushing 14, on its upper side, wherein the collar 27 only radially overlaps an outer edge of the upper end face of the eccentric bushing 14. The eccentric bushing 14 has at least one driver 17 extending axially beyond the end face on its upper end face, which can be formed as a pin, cam, or driver lug 17 (also referred to as lug 17 in short), which in the installed state engages, radially past the collar 27 of the middle housing 7 on the inside, in the corresponding at least one indentation/driver groove 16 (groove 16 in short) of the driver bushing 15 located above it—in the installed state—in the upper housing 5 (see FIG. 3*a*). In this case, the eccentric bushing 14 in the middle housing 7 and the driver bushing 15 in the bearing bushing 18 of the upper housing 5 are each mounted pivotably in principle, so that via the at least one tongue-and-groove connection 16, 17 of the two bushings 14, 15, pivots of one bushing can be transferred to the other bushing. Only one indentation or driver groove 16 and one driver 17 are shown here for the sake of comprehensibility. However, it is also conceivable to provide multiple drivers 17 and driver grooves 16, or also two drivers 17, which can engage in the same correspondingly designed driver groove 16.

Alternatively, the formation of the at least one lug 17 on the eccentric bushing 14 can also be formed as a pin incorporated into the eccentric bushing 14, wherein the pin is insertable on one side without play into a corresponding recess of the eccentric bushing 14. The pin is either plugged or screwed precisely fitted and detachably into the recess and can then be placed either preassembled in the recess or can be placed in the recess during the installation on location. In another variant, the pin is pressed, adhesively bonded, or welded into the recess. The pin can also be integrally formed with the eccentric bushing. With its opposite side, the at least one pin engages with play in the corresponding at least one indentation/driver groove 16 of the driver bushing 15 in the upper housing 5 located above it.

In another alternative, the at least one tongue-and-groove connection is implemented structurally inverted, i.e., the eccentric bushing 14 has the at least one indentation/groove, while the driver bushing 15 has at least one lug or a cam or pin. The at least one driver 17 (lug/cam/pin) advantageously engages with some play in the at least one indentation/groove 16. The play is dependent in this case on the shape and size of the driver 17 and on the shape of the indentation/groove 16 and the geometrical dimensions of eccentric sleeve 14 and pin or eccentric middle pin section 11; or in other words on the eccentricity dimensions.

In the example shown in FIG. 4, the indentation/groove 16 has a more or less rectangular cross section having rounded corners which extend approximately radially. However, other cross sections are also conceivable having radial extension, for example, slotted, approximately triangular, or other types of polygonal cross sections preferably having rounded corners or also cross sections having curved edges, such as circular, elliptical, drop-shaped cross sections, etc. The indentation/groove 16 is adapted in the shape and size thereof to the shape and size of the engaging driver 17 and to the eccentricity dimensions.

Figure 3A:
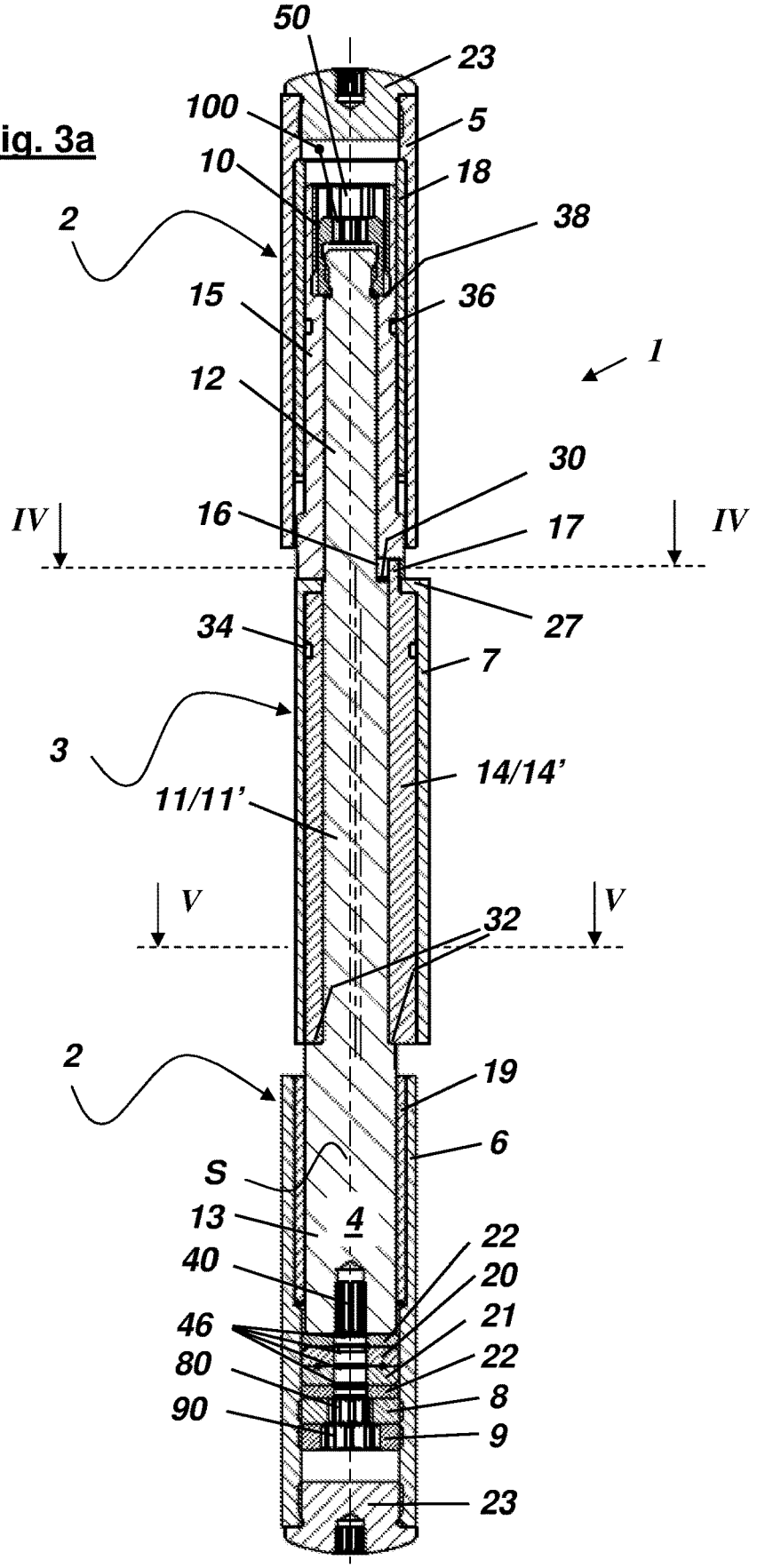
FIG. 3*a*: shows the door hinge from FIG. 2 in the assembled state in a sectional view along section line III-III in FIG. 2.

To facilitate the installation of the door hinge 1, various elements of the door hinge are preassembled: In particular, the upper bearing bushing 18 is pressed into the upper housing 5 of the frame hinge part 2, while the driver bushing 15 is pivotably inserted into the upper bearing bushing 18 and secured against falling out—for example, by means of an O-ring. In addition, the eccentric bushing 14 is inserted pivotably into the middle housing 7 of the leaf hinge part 3 and also secured against falling out therein—for example, by means of an O-ring. Driver bushing 15 and eccentric bushing 14 can each have a corresponding ring groove 34, 36 for accommodating the O-ring (FIG. 3*a*).

If the middle housing 7 of the leaf hinge part 3 is inserted between the two housings 5, 6 of the frame hinge part 2, the pin 4 can be inserted into all three housings 5, 6, 7 and/or into the bushings 19, 14, 15/18 mounted in the housings. The pin 4 can be secured in the housings 6, 7, 5 by screwing an adjusting screw 8 into the internal thread, which is accessible from below, of the lower housing 6. A lock screw 9 can optionally be provided for securing the adjusting screw 8. Adjusting screw 8 and lock screw 9 are embodied as hollow screws having continuous, central middle opening, wherein the middle openings each have a drive profile 80, 90 for the interaction with a corresponding wrench for pivoting the screws 8, 9 (FIG. 1). Accordingly, the reverse procedure is used for the removal or disassembly of the door hinge 1.

Optionally, a snap ring and a circumferential groove in the pin 4 and, at the same height, a ring groove in the corresponding bushing 15, 14, 19 can be provided as a break-in safeguard 60, 61, 62, 63, as shown in FIGS. 3*b* to 3*e*.

Figure 3B:
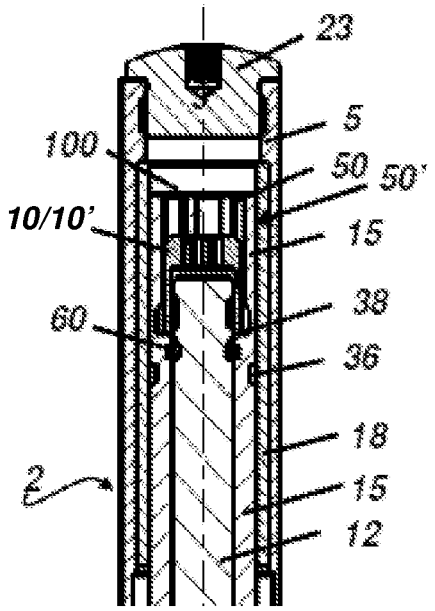
FIGS. 3*b*-3*e*: show various sections of the door hinge from FIG. 3*a* in a similar sectional view, each comprising break-in safeguard.
Figure 3C:
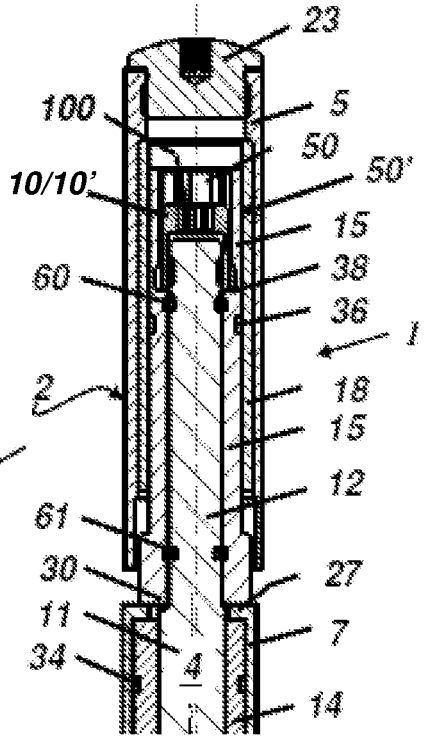
Figure 3D:
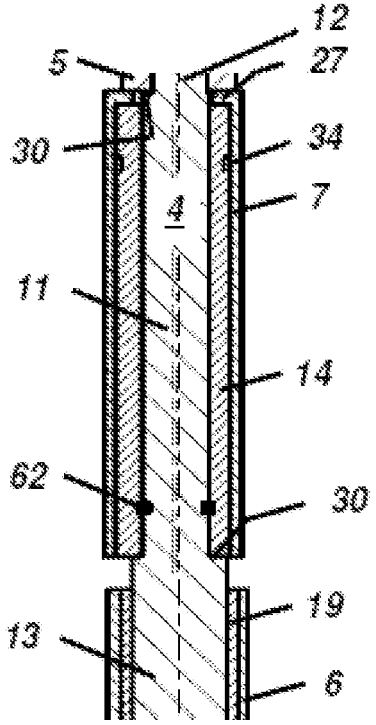
Figure 3E:
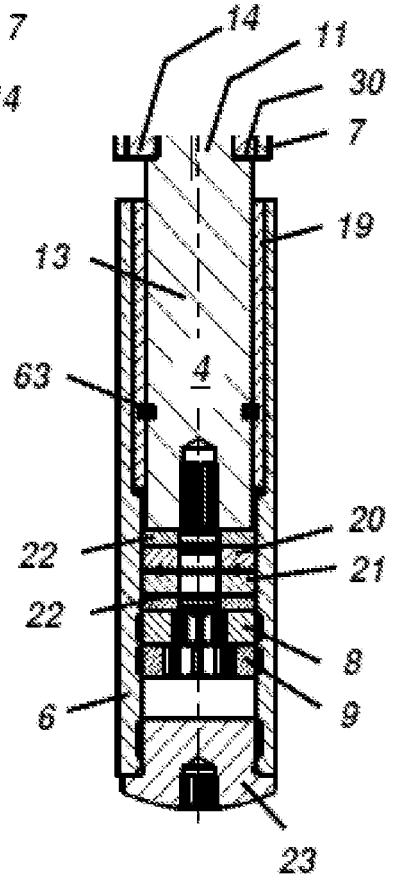
Figure 3F:
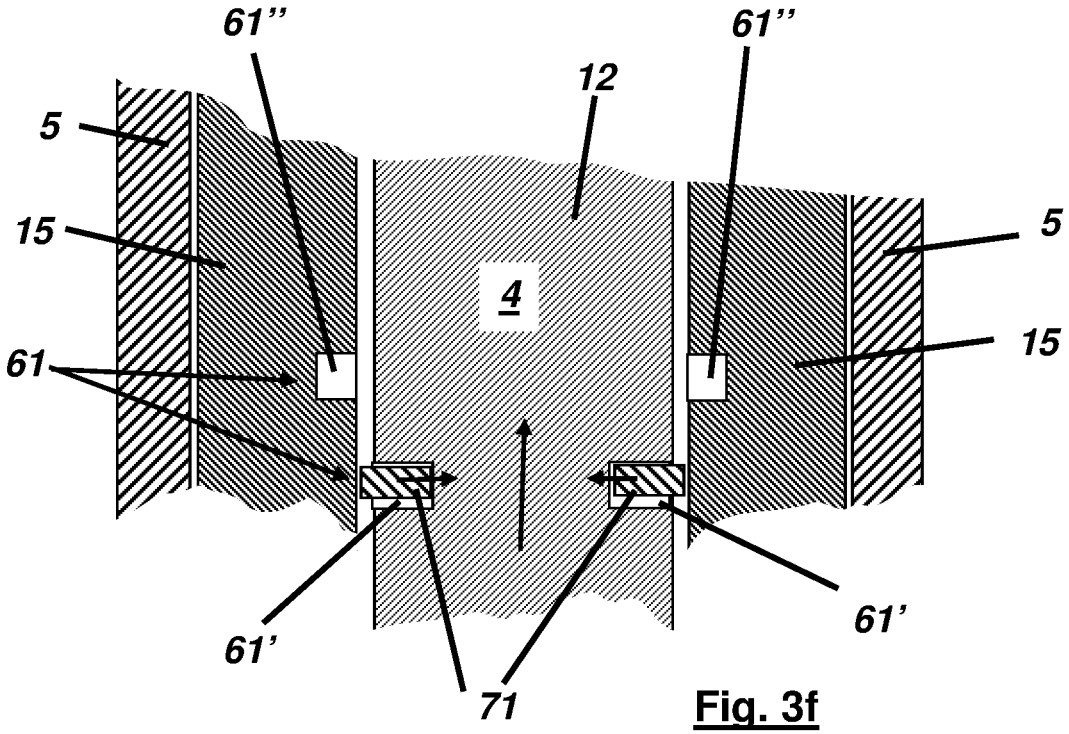
FIGS. 3*f*-3*g*: show, in a sectional view similar to FIG. 3*a* and enlarged, an assembly of parts of the door hinge comprising break-in safeguard, as shown in FIG. 3*c;*
Figure 3G:
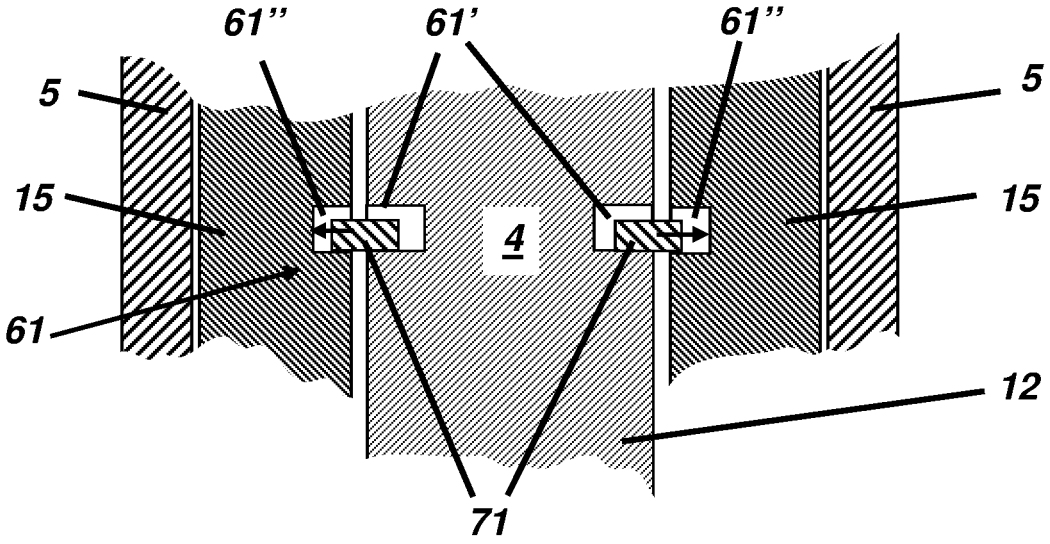
Figure 5:
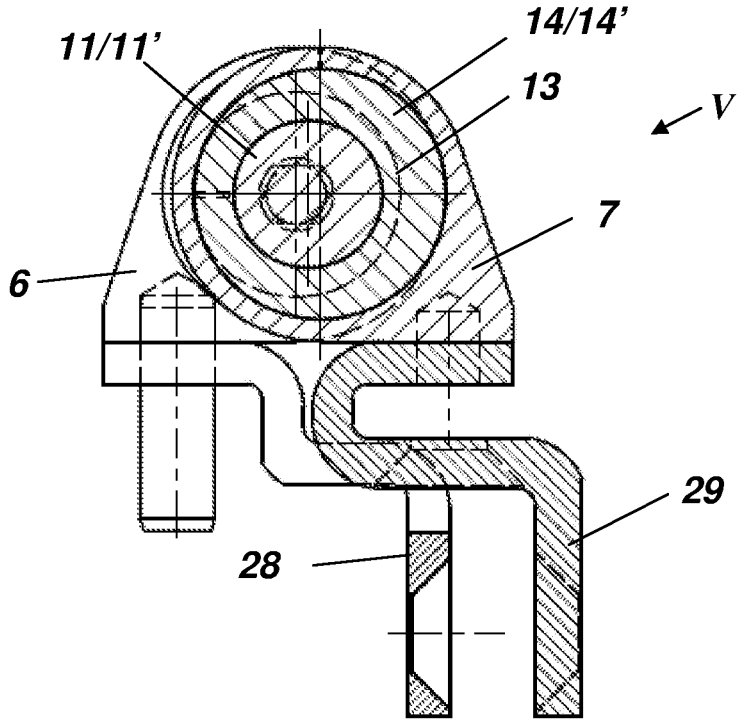
FIG. 5: shows the door hinge according to the invention from FIG. 3*a* in a sectional view along section line V-V in FIG. 3*a* having invisible outlines in the elements located in the background, which are indicated by dashed lines.

As a break-in safeguard 60, 61, 62, 63, before the insertion of the pin 4 into the housings 5, 7, 6, a snap ring is pressed into the circumferential groove of the pin 4, as shown in enlarged form by way of examples in FIGS. 3*f* and 3*g* on the basis of the upper pin section 12. In the lower region of the upper pin section 12, the break-in safeguard 61 is implemented by a circumferential groove 61' in the pin 4 and by a ring groove 61" in the driver bushing 15 and also by a snap ring 71. FIG. 3*f* shows the insertion (large arrow in the axial direction from bottom to top) of the pin 4 from below into the housing 5 or the driver bushing 15. In FIG. 3*f*, the snap ring 71 is pressed into the circumferential groove 61' of the pin 4 (small radial arrows inward). The inner walls of the driver bushing 15 press the snap ring 71 radially inward into the circumferential groove 61' of the pin 4 during the insertion of the pin 4. If the pin 4 has reached its end position (FIG. 3*g*), circumferential groove 61' and ring groove 61" are thus located at the same height and the pressure oriented radially inward on the snap ring 71 decreases. The snap ring 71 spreads out (small arrows radially outward). The snap ring 71 fills a part of the circumferential groove 61' and a part of the ring groove 61", each with radial play, so that the pin 4 is axially secured, but is nonetheless pivotable with its upper pin section 12 in the driver bushing 15. The description provided here for the break-in safeguard 61 applies similarly to all variants of the break-in safeguard 60, 61, 62, 63 described hereafter. Due to the spreading out of the snap ring into the respective ring groove and the respective (radial) partial filling of the ring groove and circumferential groove resulting therefrom, the snap ring secures the pin 4 in the corresponding bushing 14, 15, 19 in the axial direction, so that it is not possible to pull the pin 4 out of the housings 5, 7, 6 and it is thus not possible to remove the door hinge 1 by loosening the adjusting screw 8 and pulling out the pin 4. However, the snap ring has play in the radial direction, so that the pin 4 is pivotable in the bushing in spite of the snap ring.

The break-in safeguard 60, 61 is preferably located in the region of the upper pin section 12, as shown in FIGS. 3*b* and 3*c*. The break-in safeguard 60 is particularly advantageously arranged as a thread recess in the upper end region of the upper pin section 12 and has a recess at the corresponding height in the driver bushing 15, so that the snap ring can be inserted before the installation from above over the pin 4 into the circumferential groove (cf. FIG. 3*b*).

A break-in safeguard 61 in the lower region of the upper pin section 12 is also conceivable, as described in greater detail under the reference sign 61 in FIG. 3*c* and in FIGS. 3*f*, 3*g*. The snap ring 71 is again inserted before the installation into the recess/circumferential groove 61' of the pin 4. The snap ring 71 spreads out as soon it has space for this due to the similar recess/ring groove 61" in the driver bushing 15 and axially secures the pin 4 in the driver bushing 15.

As shown by way of example in FIG. 3*c* on the basis of the break-in safeguards 60, 61, it is also conceivable to provide more than one break-in safeguard.

In a further variant, a break-in safeguard 62 is provided in the middle section 11 of the pin 4, as shown in FIG. 3*d*. By means of the break-in safeguard 62, the pin 4 is axially secured in the eccentric bushing 14, wherein the middle pin section 11 remains rotatable because of the radial play of the snap ring in the eccentric bushing, and the axial adjustability also remains ensured because of the axial play of the snap ring.

It is also conceivable to provide a break-in safeguard 63 in the lower pin section 13, which secures the pin 4 axially in the bearing bushing 19 in the lower housing 6 of the frame part 2. The snap ring can then simply be pushed from below over the lower pin end before the installation and pressed into the circumferential groove of the lower pin section 13. The statements above apply again with respect to play of the snap ring in circumferential groove and ring groove.

In order that the axial adjustability remains unobstructed in spite of axial securing of the pin 4, enough play is provided in the axial direction for the snap ring in the circumferential groove and the ring groove as is provided by the adjusting screw 8 in axial adjustability for the door hinge 1. The play in the axial direction for the snap ring in the circumferential groove and the ring groove is provided above all in the last-mentioned variants with the break-in safeguard 63 in the lower pin section 13, but can also be provided in all other variants, which simplifies the production.

The pin 4 is rotatably mounted in the assembled state in the lower housing 7, more precisely in its lower bearing bushing 19 and on the adjusting screw 8—or on washers 22 and/or thrust washers 20, 21 arranged between the pin 4 and adjusting screw 8. The concentric axes of the upper section 12 and the lower section 13 of the pin 4 then form the pivot axis S of the door hinge 1 in the installed state, about which the leaf element fastened on the leaf hinge part 3 is pivotable.

The pin 4 secured in the three housings 5, 6, 7 is thus inserted in the assembled state of the door hinge 1 at least with a large part of its lower section 13 into the lower bearing bushing 19 of the lower housing 6 (see FIG. 3*a*). A drive profile 40 of the pin 4 is located at the lower end of the lower pin section 13, so that the inserted pin 4 can be pivoted using a wrench matching with this drive profile 40. The pin 4 is inserted with its middle section 11 into the eccentric bushing 14 of the middle housing 7. In this case, the eccentric bushing 14 rests with its lower end face on the lower shoulder 32 of the pin 4, which separates the lower section 13 from the middle section 11 of the pin 4. The middle housing 7 of the hinge part 3 rests with its collar 27 on the opposing upper end face of the eccentric bushing 14, so that the at least one driver 17 of the eccentric bushing 14 can engage past on the axial inside on the collar 27 of the middle housing 7 in the at least one driver groove 16 of the driver bushing 15 located above it. With its upper section 12, the pin 4 is inserted into the driver bushing 15 of the upper housing 6, wherein the driver bushing 15 rests with its lower end face at least partially on the collar 27 of the middle housing 7.

In general, the internal diameter of the driver bushing 15 approximately corresponds to the external diameter of the upper pin section 12 or is minimally larger than this diameter, so that the pin 4 is pivotably mounted in principle with its upper section 12 in the driver bushing 15.

The pin 4 is provided at the upper end of its upper section 12 with a thread, which is used to accommodate a lock element 10. In most of the examples shown here, the lock element 10 is designed as a lock nut 10', for example, as also in FIG. 3*a*. The pin 4 thus has an external thread here at the upper end of its upper section 12, onto which the lock nut 10' can be screwed. However, the design as a lock screw 10", which would then be screwed into an internal thread of the pin 4 (see FIG. 3*h*) would also be conceivable. In order that the lock element 10 can be used and tightened or loosened, respectively, and the driver bushing 15 is pivotable independently of the pin 4, the driver bushing 15 inserted into the upper housing 5 protrudes with its upper end 50' beyond the upper section 12 of the pin 4 inserted therein and also has an enlarged internal diameter in this region protruding beyond the pin 4. The enlarged internal diameter of the driver bushing 15 in the upper end 50' is selected as large enough that it enables the insertion and screwing together of the lock element 10—in the form of the lock nut 10' here—with the thread of the upper pin section 12. The lock element 10 has a drive profile 100 for this purpose, which can be operated using a corresponding wrench. The internal diameter of the driver bushing 15 enlarged in the upper end region 50' forms an offset 38 in relation to the otherwise smaller internal diameter of the driver bushing 15, which is used as a buttress for the lock element 10 upon tightening of the lock element 10. The internal diameter enlarged in the upper end region 50' of the driver bushing 15 is also formed as a drive profile 50, so that the pivoting of the driver bushing 15 can take place by means of a wrench fitting in this drive profile 50.

By way of the clamping described hereafter of the pin 4 with the leaf hinge part 3, the pin 4 is connected in a rotationally-fixed manner to the leaf hinge part 3 and therefore to a leaf element (not shown) fastened on the leaf hinge part 3, whereby the leaf element fastened on the leaf hinge part 3 is pivotable about the pivot axis S.

The pin 4 is clamped in the following manner with the middle housing 7 of the leaf hinge part 3.

The lock element 10 screwed onto the thread of the upper pin section 12 is accessible from above through the upper housing 5 and the upper end region 50' of the driver bushing 15. It has the drive profile 100 for adjustment, for example, a hex socket or star, so that tightening or loosening of the lock element 10 is possible using a corresponding hex wrench or star wrench by access from above through the upper housing 5 and the enlarged internal diameter in the end region 50' of the driver bushing 15. By way of the tightening of the lock element 10, on the one hand, the pin 4 is drawn upward, on the other hand, the lock element 10 is pressed downward, against the offset 38 of the driver bushing 15 used as the buttress. Furthermore, the driver bushing 15 is thus pressed downward against the collar 27 of the middle housing 7, which presses the eccentric bushing 14 located therein against the lower shoulder 32 of the pin 4. Therefore, the following components of the three-part door hinge 1 are clamped to form a packet by the tightening of the lock element 10: pin 4, middle housing 7, eccentric bushing 14 located in the middle housing, driver bushing 15 located in the upper housing 5. In the operationally-ready state, the lock element 10 is tightened, so that in the operationally-ready state, the pin 4 forms a unit by means of clamping with the following components of the door hinge 1:

- with the middle housing 7,
- with the eccentric bushing 14 enclosing the middle pin section 11,
- with the driver bushing 15 enclosing the upper pin section 12, and
- with the lock nut 10' or lock screw 10" causing the clamping as the lock element 10.

The driver bushing 15 together with the upper pin section 12 can still rotate freely in the upper bearing bushing 18 of the upper housing 5, however, and the lower pin section 13 is also still freely rotatable in the lower bearing bushing 19 and freely rotatable on the adjusting screw 8 or the thrust washers 20, 21 and washers 22 in the lower housing 6. Because of this rotation freedom and because of the clamping of the pin 4 with the middle housing 7 of the leaf hinge part 3, it is ensured that pin 4 rotates in relation to the frame hinge part 2 upon pivoting of the leaf element and thus the leaf element is pivotable about the pivot axis S of the door hinge 1. Washers 22 and thrust washers 20, 21 are optionally provided between the lower part of the pin 13 and the adjusting screw 8 to absorb the pressure and friction forces during this rotation.

A course, it is also possible to design the lock element 10 as a lock screw 10", as shown in FIG. 3*h*, instead of as a lock nut 10', as shown in FIGS. 1, 3*a*, 3*b*, 3*c*. The pin 4 is then provided with an internal thread 100*c* at its upper end of its upper pin section 12 instead of with an external thread and instead of the lock nut 10' which can be screwed on (see FIGS. 1, 3*a*), a lock screw 10" which can be screwed into this internal thread is provided. A screw head 100*b* of this lock screw 10" is provided with a drive profile 100', which is adjustable using a corresponding wrench similarly to the above-described lock nut 10'. The screw head 100*b* of the lock screw 10" protrudes radially beyond the pin 4 and interacts with a corresponding offset 38' of the driver bushing 15', so that (similarly to the above-described lock nut 10' having the offset 38), by tightening the lock screw 10", on the one hand, the pin 4 is drawn upward, on the other hand, the lock screw 10' is pressed downward, against the offset 38' of the driver bushing 15' used as a buttress, and thus finally the pin 4, the middle housing 7, the eccentric bushing 14 located in the middle housing, and the driver bushing 15 located in the upper housing 5 are clamped to form a packet.

The thrust washers 20, 21 and the washers 22 have central, through-hole openings 45, 46, which are dimensioned so that the wrench matching with the drive profile 40 of the pin 4 can be guided through these middle openings 45, 46 and the pin 4 can be pivoted.

In one particular embodiment, the thrust washers 20, 21 have distribution grooves for an optimum distribution of a lubricant, as also described, for example, in EP 2586944 of the same applicant. Using a tip of a corresponding lubricant container designed as a spray nozzle, the continuous, central middle openings 46 of the thrust washers 20, 21 can be accessed through the lock screw 9 and adjusting screw 8 designed as hollow screws or through the drive profiles 90, 80 thereof, respectively, and lubricant can be introduced. The supply with lubricant is very conveniently and easily possible in a door hinge 1 thus designed, since only the lower cover screw 23 has to be unscrewed from the door hinge 1 for this purpose.

The adjusting screw 8 and the optional lock screw 9 are used, in addition to absorbing the load of the leaf element, also for the axial adjustment of the pin 4 and therefore—with vertical installation—for a vertical adjustment of the leaf element (door leaf/window sash). The adjusting screw 8 and the optional lock screw 9 are designed as hollow screws having pervasive middle opening, wherein the middle openings are each formed as drive profiles 80, 90, respectively. For the axial adjustment of the pin 4, firstly the countering is loosened at the lock screw 9 in the lower housing 6 and then the desired axial position is set using the adjusting screw 8. In order that the lock screw 9 does not have to be entirely unscrewed from the lower housing 6 for the adjustment, in order to reach the adjusting screw 8, the drive profile 90 of the lock screw 9 is larger than the drive profile 80 of the adjusting screw 8. It thus has, for example, a wrench width of a hex socket or star profile which is larger by 1 to 2 numbers. In this manner, after the loosening of the lock screw 9, the drive profile 80 of the adjusting screw 8 can be accessed using a matching wrench corresponding to the drive profile 80 of the adjusting screw 8 through the lock screw 9 or through the drive profile 90 formed as the middle opening, and the adjusting screw 8 can be adjusted. Using the corresponding larger wrench matching with the drive profile 90 of the lock screw 9, after the adjustment of the adjusting screw 8, the lock screw 9 can be tightened again and the performed setting can thus be secured. As indicated above, although the lock screw 9 is shown in all of the figures, the lock screw 9 is optional: it is clear to a person skilled in the art that the functionality is also secured solely via an adjusting screw 8. Only the permanent maintenance of the selected setting is somewhat less secure without lock screw.

If the described clamping by means of the lock element 10 is loosened, the leaf element can thus be translationally adjusted in two dimensions orthogonal to the pivot axis S by the mechanisms described hereafter of the door hinge 1 according to the invention.

As already described above and shown once again clearly in FIGS. 3*a* and 4, for this purpose the driver bushing 15 has an indentation or driver groove 16 extending radially from the inside to the outside, which extends along a small circumferential segment of the driver bushing 15. The groove can extend radially from the very inside to the very outside, or also only over a partial region, as shown in FIG. 4, where the indentation/groove 16 leaves a thin wall standing on the outside. The eccentric bushing 14 has an axially extending driver 17 (lug/cam/pin), which engages in the indentation/groove 16 of the driver bushing 15 with at least radial play and thus forms a tongue-and-groove connection: The groove 16 is dimensioned in the circumferential direction so that it also accommodates the lug 17 in this direction with play. In this manner, jamming of the tongue-and-groove connection is prevented. If one holds FIG. 3*a* before the eyes and imagines that the eccentric bushing 14 and the driver bushing 15 execute a 180° rotation, it is then evident that—as a result of the eccentricity between upper pin section 12 and middle pin section 11—the lug 17 would "travel" radially inward along the groove 16. During such an adjustment, the middle housing 7 would also be displaced to the left (according to FIG. 3*a*).

This rotational adjustment takes place, as already described above, on the one hand by means of a corresponding wrench via the drive profile 50 of the driver bushing 15, which it has at the upper end 50' thereof. In particular, this drive profile 50 is also a hex socket, star socket, etc., which is again dimensioned sufficiently large that, on the one hand, the lock element 10 passes through it and, on the other hand, the lock element 10 can be reached using a profiled tool matching correspondingly to its drive profile 100, 100'. The driver bushing 15 is moreover, as also already described above, sufficiently long that it protrudes beyond the upper part of the pin 12, so that the drive profile 50 thereof can readily be reached and used as intended via the lock element 10.

If—as stated—the clamping of the "packet" is thus disengaged by loosening the lock element 10, on the one hand, the driver bushing 15 can be pivoted using a tool, which as a consequence also pivots the eccentric bushing 14 and results in an adjustment of a first eccentricity 14'. On the other hand—simultaneously or sequentially—the rotational location of the pin 4 can be adjusted independently of the adjustment of the eccentric bushing 14, which results in particular in a rotational adjustment of the eccentric middle pin section 11 in the eccentric bushing 14 and thus in the adjustment of a second eccentricity 11'.

This rotational adjustment of the pin 4 is brought about by inserting a matching wrench through the lower end of the lower housing 6 in the middle openings of adjusting screw 8 and optional lock nut 9, thrust washers 20, 21, and washers 22 into the drive profile 40 of the pin 4 located in the lower end of the lower pin section 13 and pivoting the pin 4 with the aid of the wrench. The drive profile 40 is again, for example, a hex socket, star socket, etc., which is correspondingly small in relation to the middle openings 45 of the washers 22 and the middle openings 46 of the thrust washers 20, 21 and also in relation to the middle openings or drive profiles 80, 90 of the lock screw 9 and adjusting screw 8 designed as hollow profile screws so that the matching wrench fits through all of these middle openings 45, 46 or drive profiles 80, 90, respectively, and can be inserted into the drive profile 40 of the pin 4. By pivoting the wrench in the drive profile 40 of the pin 4, the rotational location of the pin 4 can be adjusted unobstructed.

The pin 4 is preferably integrally formed, i.e., the upper pin section 12, the middle pin section 11, and the lower pin section 13 are formed from one piece, for example, by turning or casting, or the pin sections 12, 11, 13 are manufactured as separate parts and are connected to one another in an axially-fixed and rotationally-fixed manner.

Figure 7:
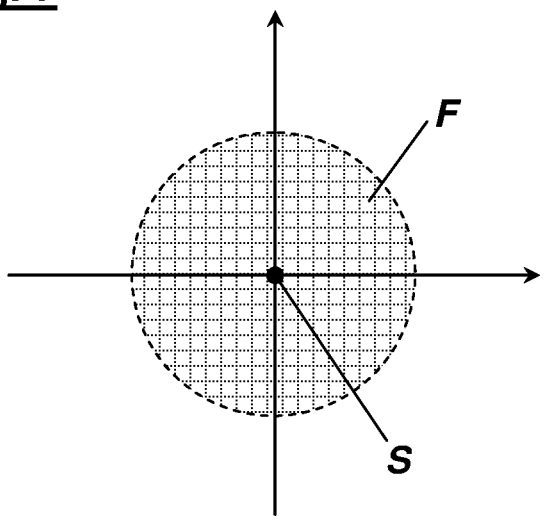
FIG. 7: shows a schematic view of the adjustment range of the door hinge.

The adjustment of the rotational location of the pin 4 adjusts—independently of the first eccentricity 14'—the second eccentricity 11', namely the eccentric middle pin section 11. By way of the adjustment of the two eccentricities 14', 11', the middle longitudinal axis T of the middle housing 7—and with it the middle housing 7 of the leaf hinge part 3 and the leaf element (door leaf/window sash) fixedly connected to the leaf hinge part—can be displaced parallel to the pivot axis S of the door hinge 1; specifically within a circular area F, which is defined by the two eccentricities 11', 14' and is perpendicular to the pivot axis S of the door hinge 1, to an arbitrary point, wherein the center of the circular area F is the pivot axis S (FIG. 7).

If a desired adjustment has been successfully performed via the drive profile 50 of the driver bushing 15 and via the drive profile 40 at the lower end of the lower pin section 13, this setting is "frozen" by means of the lock element 10, i.e., the "packet" is clamped.

All adjustments and the subsequent fixing of these adjustments—i.e., both the adjustment in the axial direction (first dimension) and also the two adjustments orthogonal to the axis S (second and third dimensions)—are possible without taking a leaf element fixedly connected to the leaf hinge part (3) off of the hinge and without removing the three-part door hinge 1.

The adjustability is different depending on the dimension of the door hinge 1. In one preferred embodiment, the door hinge 1 is axially adjustable by approximately ±4 mm. In this embodiment, any point within a theoretical circle of in particular approximately 03.2 mm about the pivot axis S can be set orthogonally to the pivot axis.

However, other adjustment distances can also be implemented depending on the dimension of the door hinge.

FIGS. 6 to 10 illustrate the adjustment options of the door hinge according to the invention in a simplified 3D view and a schematic sketch of the cross section in the middle housing in each case.

Figure 6:
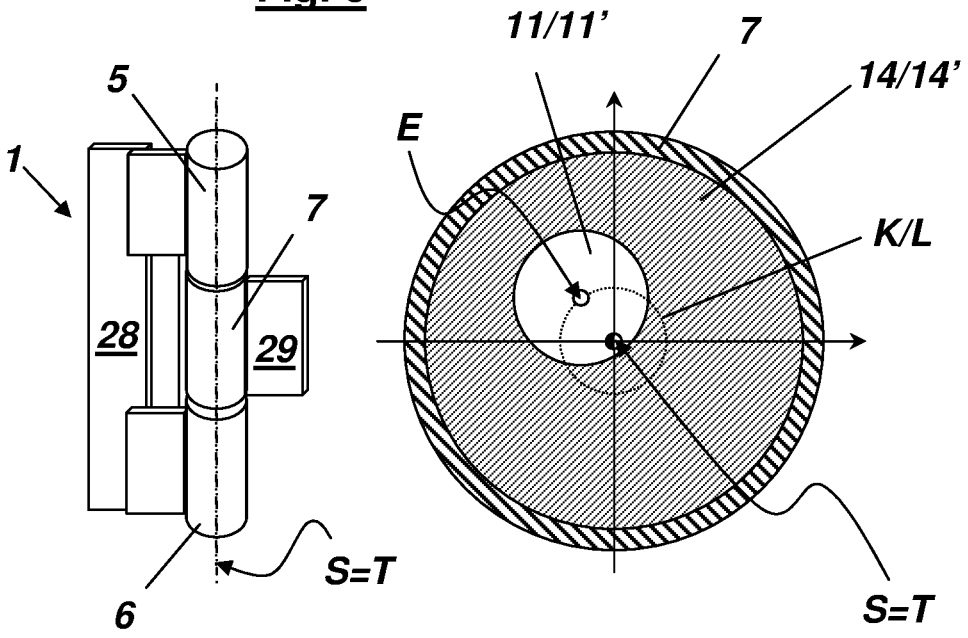
FIG. 6: shows a schematic view of the neutral position of the door hinge.

FIG. 6 shows the set state in which the pivot axis S is aligned concentrically with the middle longitudinal axis T of the middle housing 7. In this case, the pivot axis S corresponds to the concentric, middle longitudinal axes of the upper and the lower pin sections 12, 13. This is more or less a neutral state without adjustment, in which the eccentricities 11', 14' of the middle pin section 11 and the eccentric bushing 14 mutually cancel out. This is possible since the two eccentricities are dimensioned identically. (A construction having different eccentricities 11', 14' is also conceivable, wherein there would not be a neutral position and the middle housing could thus not be adjusted such that it aligned with the upper and lower housings.)

FIG. 7 shows the possible adjustment range F in the same coordinate system which is also shown in FIG. 6 and FIGS. 8-10. The adjustment range F comprises all positions which the middle longitudinal axis T of the middle housing can assume in parallel to the pivot axis S by adjustment of the eccentric bushing 14 and the eccentric pin section 11.

Figure 8:
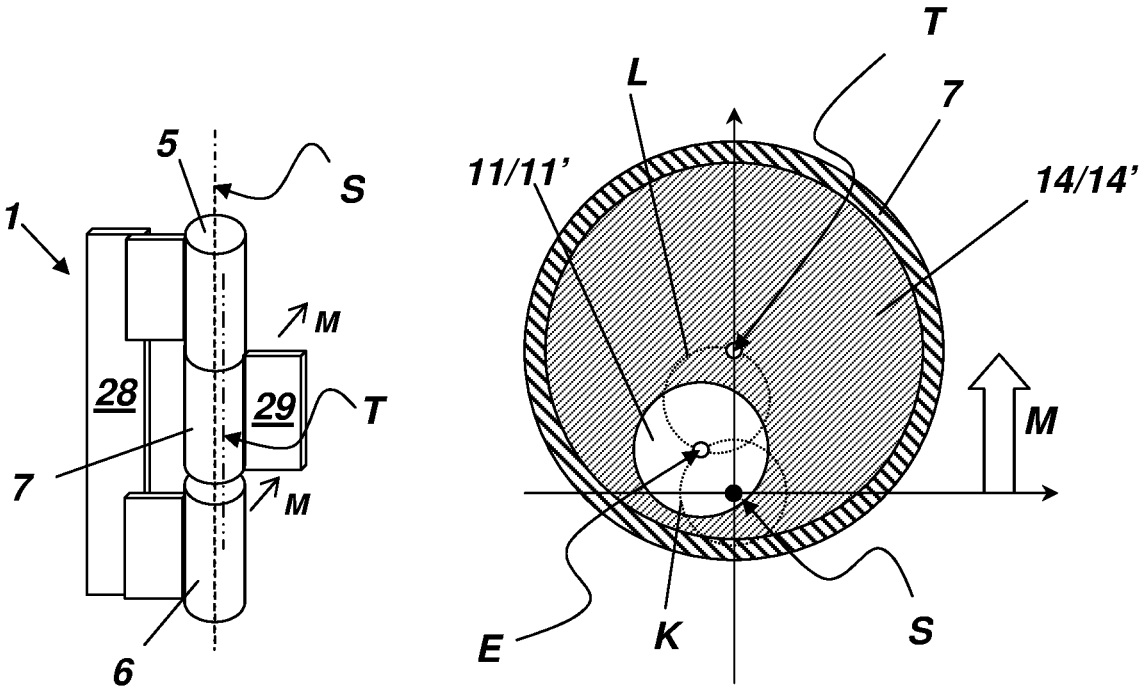
FIG. 8: shows a schematic view of a first adjustment of the door hinge.

FIG. 8 shows a position of the middle longitudinal axis T of the middle housing 7 in relation to the pivot axis S, in which, for example, a door leaf is displaced orthogonally away from the frame in the direction of the surface normal of the door leaf (door leaf represented by the web 28 and its surface normal N). Such an adjustment is achieved by pivoting/adjusting the pin 4 and the eccentric bushing 14 unequally. The dashed circular line K enclosing the pivot axis S shows the orbit on which the middle longitudinal axis E of the eccentric middle pin section 11 is displaceable. The second dashed circular line L, on which both the middle longitudinal axis T of the middle housing 7 and also the middle longitudinal axis D of the eccentric middle pin section 11 lie, corresponds to the possible displacement of the middle longitudinal axis T of the middle housing 7 in relation to the middle longitudinal axis T of the middle pin section 11 (and/or in relation to the middle longitudinal axis of the interior of the eccentric bushing 14). In total, the adjustment indicated by the arrow M results.

Figure 9:
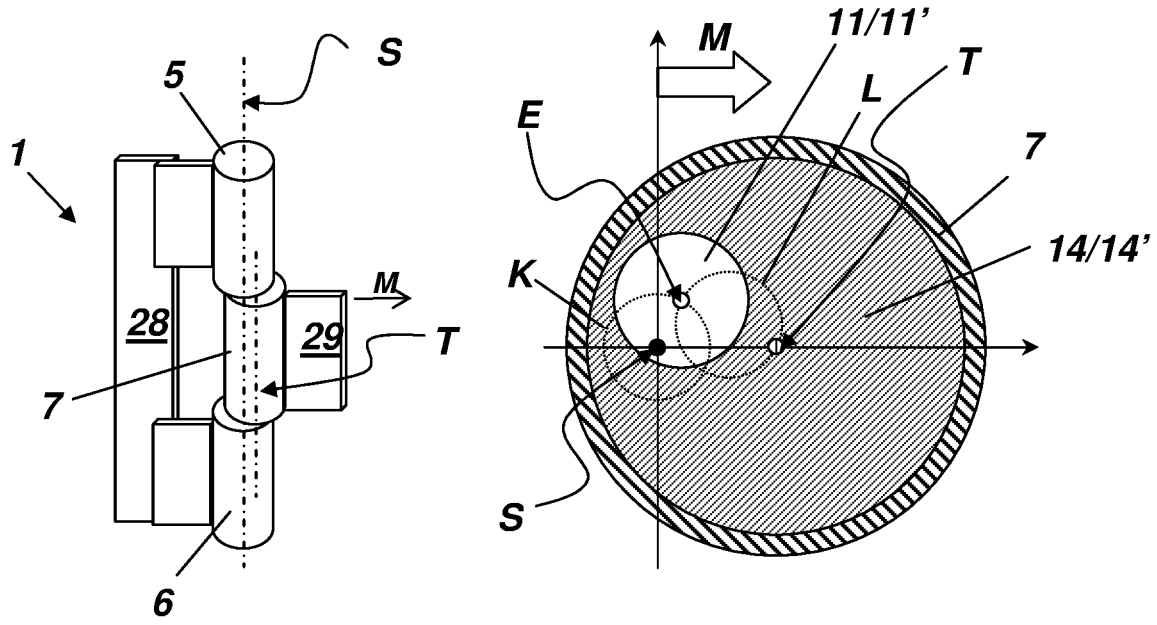
FIG. 9: shows a schematic view of a second adjustment of the door hinge.

Correspondingly, FIG. 9 shows an adjustment, for example, of a door leaf along its door leaf plane.

Figure 10:
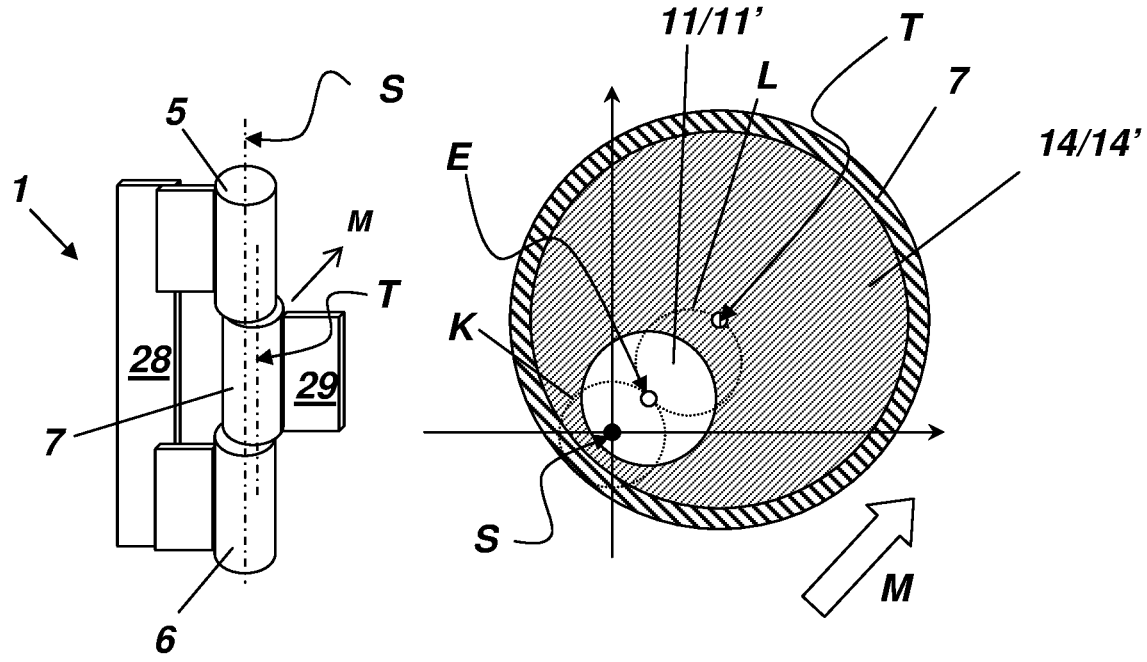
FIG. 10: shows a schematic view of a third adjustment of the door hinge.

FIG. 10 shows an adjustment of the middle longitudinal axis T of the middle housing 7 in relation to the pivot axis S in both dimensions, i.e., both somewhat in the direction of the door leaf plane and also somewhat in the direction of the surface normal of the door leaf, so that a displacement vector having alignment of the arrow M results.

The advantages of this three-part door hinge are:

- its adjustability in three dimensions, wherein all adjustments and the subsequent fixing of these adjustments can be carried out without taking a leaf element fixedly connected to the leaf hinge part off of the hinge;
- its elegant appearance, which is enabled by the complete integration of the adjustment mechanism and also the mechanism for fixing and loosening the adjustment in the interior of the housing of the door hinge;
- the possibility of firstly fixing leaf hinge part and frame hinge part separately from one another on the desired frame or leaf element, respectively, and only finishing assembling the door hinge on location when the leaf element is supplied to the frame and more or less inserted therein,
- and, in a special embodiment, the possibility of also securing the door against break-in by means of the door hinge,
- and, in a further special embodiment, the possibility of protecting the door hinge by means of cover screws from environmental influences, such as moisture and/or introduction of dust and/or also preventing the escape of lubricant by way of the cover screws.

It is obvious that the exemplary embodiments shown and explained above are illustrated solely schematically. In particular, it is to be noted that details which are explicitly illustrated and explained in the context of the scope of protection of the patent claims are usable both separately from one another and also in any combination with one another.

The invention claimed is:

1. A three-part door hinge enabling pivoting of a leaf element in relation to a frame and about a pivot axis of the door hinge, comprising:

- a pin having a lower pin section, a middle pin section, and an upper pin section;
- a frame hinge part for fixing on a frame, the frame hinge part having an upper housing and a lower housing which are fixed at a defined distance and concentrically in relation to one another;
- an adjusting screw configured for adjusting an axial position of the pin relative to the frame hinge part; and
- a leaf hinge part for fastening on a leaf element, the leaf hinge part having a middle housing, which is arranged between the upper and the lower housings, wherein the pin extends through all housings, wherein the adjusting screw provides an adjustability of the door hinge in a first dimension parallel to the pivot axis, wherein two eccentricities of an eccentric bushing and the middle pin section are provided within a middle housing of the leaf hinge part, which interact such that a middle longitudinal axis of the middle housing is shiftable parallel to the pivot axis to any arbitrary point inside a virtual circular plane defined by the two eccentricities and aligned orthogonally to the pivot axis, resulting in an adjustability in two further dimensions orthogonal to the pivot axis, wherein the middle pin section is formed eccentrically with respect to the upper and the lower pin sections, wherein the middle pin section is enclosed by the eccentric bushing, wherein the eccentric bushing is in turn enclosed by the middle housing of the leaf hinge part, wherein the middle pin section, the eccentric bushing, and the middle housing of the leaf hinge part are connectable to one another in a rotationally-fixed manner, while the pin being mounted such that the upper pin section is located in the upper housing and the lower pin section is located in the lower housing so that the pin is rotatable about the pivot axis, wherein the lower pin section has a larger diameter than the middle pin section which has a larger diameter than the upper pin section, wherein the eccentric bushing rests with a lower end face on a lower shoulder of the pin and the middle housing has a collar which rests at least partially on the upper end face of the eccentric bushing, and wherein the upper pin section in the upper housing is enclosed by a driver bushing and the driver bushing and the eccentric bushing are connected to one another by at least one tongue-and-groove connection such that a rotational adjustment of one bushing is transferred to the other bushing.

2. The door hinge according to claim 1, wherein the pin has a thread that accommodates a lock element on its upper end, the lock element being a lock nut or a first lock screw, the lock element providing an adjustability of the eccentric, middle pin section and the eccentric bushing in a loosened state, and fixing an adjustment of the eccentric, middle pin section and the eccentric bushing in a tightened state.

3. The door hinge according to claim 1, wherein the pin has on its lower end face a drive profile for the rotational adjustment of the eccentrically formed middle pin section and the adjusting screw for the axial adjustment of the pin is designed as a hollow screw having a drive profile, wherein the drive profile represents a through-hole opening and is at least sufficiently larger than the drive profile of the pin so that a wrench matching with the drive profile of the pin is insertable through the drive profile of the adjusting screw and into the drive profile of the pin.

4. The door hinge according to claim 3, wherein at least one of thrust washers having through-hole openings and washers having through-hole openings are arranged between the pin and the adjusting screw, wherein the middle openings are dimensioned such that the wrench matching with the drive profile of the pin is insertable through the openings and into the drive profile of the pin.

5. The door hinge according to claim 1, wherein the adjusting screw is secureable using a second lock screw and the second lock screw is designed as a hollow screw having a drive profile, wherein the drive profile of the second lock screw represents a through-hole opening and is at least larger than a drive profile of the adjusting screw by at least an amount that allows a wrench matching with the drive profile of the adjusting screw to be guidable through the drive profile of the lock screw and to be inserted into the drive profile of the adjusting screw.

6. The door hinge according to claim 1, wherein the driver bushing protrudes with its upper end region beyond the upper end of the pin located therein, has, in this upper end region, a drive profile, for the rotational adjustment of the driver bushing and, via the at least one tongue-and-groove connection, also the eccentric bushing and wherein an internal diameter of the driver bushing in this end region is selected such that the lock element is insertable through the end region of the driver bushing and is screwable to the upper end of the pin.

7. A three-part door hinge enabling pivoting of a leaf element in relation to a frame and about a pivot axis of the door hinge, comprising:

a pin having a lower pin section, the middle pin section, and an upper pin section;

a frame hinge part for fixing on a frame, the frame hinge part having an upper housing and a lower housing which are fixed at a defined distance and concentrically in relation to one another;

an adjusting screw configured for adjusting an axial position of the pin relative to the frame hinge part; and a leaf hinge part for fastening on a leaf element, the leaf hinge part having a middle housing, which is arranged between the upper and the lower housings, wherein the pin extends through all housings, wherein the adjusting screw provides an adjustability of the door hinge in a first dimension parallel to the pivot axis, wherein two eccentricities of an eccentric bushing and the middle pin section are provided within a middle housing of the leaf hinge part, which interact such that a middle longitudinal axis of the middle housing is shiftable parallel to the pivot axis to any arbitrary point inside a virtual circular plane defined by the two eccentricities and aligned orthogonally to the pivot axis, resulting in an adjustability in two further dimensions orthogonal to the pivot axis, wherein the middle pin section is formed eccentrically with respect to the upper and the lower pin sections, wherein the middle pin section is enclosed by the eccentric bushing, wherein the eccentric bushing is in turn enclosed by the middle housing of the leaf hinge part, wherein the middle pin section, the eccentric bushing, and the middle housing of the leaf hinge part are connectable to one another in a rotationally-fixed manner, the pin being mounted such that the upper pin section is located in the upper housing and the lower pin section is located in the lower housing so that the pin is rotatable about the pivot axis, wherein the lower pin section has a larger diameter than the middle pin section which has a larger diameter than the upper pin section, wherein the eccentric bushing rests with a lower end face on a lower shoulder of the pin and the middle housing has a collar which rests at least partially on the upper end face of the eccentric bushing, wherein the pin has a thread that accommodates a lock element on its upper end, the lock element being a lock nut or a first lock screw, and wherein the pin is fixedly held together with a driver bushing, the middle housing, and the eccentric bushing in a rotationally-fixed manner by the lock element, which is arranged inside the upper housing and is screwed together with the thread at the upper end of the pin, wherein the lock element presses against an offset of the driver bushing upon tightening.

8. A three-part door hinge for the purpose of enabling pivoting of a leaf element in relation to a frame and about a pivot axis of the door hinge, comprising:

a pin;

a frame hinge part for fixing on a frame, the frame hinge part having an upper housing and a lower housing, which are fixed at a defined distance and concentrically in relation to one another; and a leaf hinge part for fastening on a leaf element, the leaf hinge part having a middle housing, which is arranged between the upper and the lower housings;

wherein the pin extends through all housings, wherein the door hinge further comprises an adjusting screw configured for adjusting an axial position of the pin relative to the frame hinge part, which results in an adjustability of the door hinge in a first dimension parallel to the pivot axis, wherein two eccentricities of an eccentric bushing and a middle pin section of the pin are provided within the middle housing of the leaf hinge part, which interact such that a middle longitudinal axis of the middle housing is shiftable parallel to the pivot axis to any arbitrary point inside a virtual circular plane defined by the two eccentricities and aligned orthogonally to the pivot axis, resulting in an adjustability in two further dimensions orthogonal to the pivot axis, wherein the pin has a lower pin section, the middle pin section, and an upper pin section, wherein the middle pin section is formed eccentrically with respect to the upper and the lower pin sections, wherein the middle pin section is enclosed by the eccentric bushing, wherein the eccentric bushing is in turn enclosed by the middle housing of the leaf hinge part, wherein the middle pin section, the eccentric bushing, and the middle housing of the leaf hinge part are connectable to one another in a rotationally-fixed manner, the pin being mounted such that the upper pin section is located in the upper housing and the lower pin section is located in the lower housing so that the pin is rotatable about the pivot axis, wherein the upper pin section in the upper housing is enclosed by a driver bushing and the driver bushing and the eccentric bushing are connected to one another by at least one tongue-and-groove connection such that a rotational adjustment of one bushing is transferred to the other bushing.

9. The door hinge according to claim 8, wherein the pin has a thread that accommodates a lock element on its upper end, the lock element being a lock nut or a first lock screw, wherein the lock element provides an adjustability of the eccentric middle pin section and the eccentric bushing in a loosened state, provides a fixing of an adjustment of the eccentric middle pin section and the eccentric bushing in a tightened state.

10. The door hinge according to claim 8, wherein the pin is fixedly held together with a driver bushing, the middle housing, and the eccentric bushing in a rotationally-fixed manner by a lock element, which is arranged inside the upper housing and is screwed together with the thread at the upper end of the pin, wherein the lock element presses against an offset of the driver bushing upon tightening, the lock element being a lock nut or a first lock screw.

11. The door hinge according to claim 8, wherein the pin has on its lower end face a drive profile for the rotational adjustment of the eccentrically formed middle pin section and the adjusting screw for the axial adjustment of the pin is designed as a hollow screw having a drive profile, wherein the drive profile is a through hole opening and is at least sufficiently larger than the drive profile of the pin so that a wrench matching with the drive profile of the pin is insertable through the drive profile of the adjusting screw and into the drive profile of the pin.

12. The door hinge according to claim 11, wherein at least one of thrust washers having through-hole openings and washers having through-hole openings are arranged between the pin and the adjusting screw, wherein the through-hole openings are dimensioned such that the wrench matching with the drive profile of the pin is insertable through the openings and into the drive profile of the pin.

13. The door hinge according to claim 8, wherein the adjusting screw is secureable using a second lock screw and the second lock screw is designed as a hollow screw having a drive profile, wherein the drive profile of the second lock screw is a through hole opening and is at least larger than a drive profile of the adjusting screw so that a wrench matching with the drive profile of the adjusting screw is guidable through the drive profile of the lock screw and is insertable into the drive profile of the adjusting screw.

14. The door hinge according to claim 8, wherein the driver bushing protrudes with its upper end region beyond the upper end of the pin located therein, has, in this upper end region, a drive profile, for the rotational adjustment of the driver bushing, and, via the at least one tongue-and-groove connection, also the eccentric bushing, and wherein an internal diameter of the driver bushing in this end region is selected such that the lock element is insertable through the end region of the driver bushing and is screwable to the upper end of the pin.

* * * * *